US005898411A

United States Patent [19]

McGaffigan et al.

[11] Patent Number: 5,898,411

[45] Date of Patent: Apr. 27, 1999

[54] SINGLE-ELEMENT, MULTI-FREQUENCY, DIPOLE ANTENNA

[75] Inventors: Francis D. McGaffigan, Escondido; John Glabe, Ramona, both of Calif.

[73] Assignee: Pacific Antenna Technologies, Inc., San Diego, Calif.

[21] Appl. No.: 08/738,459

[22] Filed: Oct. 30, 1996

Related U.S. Application Data

[63] Continuation-in-part of application No. 08/607,185, Feb. 26, 1996, abandoned.

[51] Int. Cl.[6] ..... H01Q 9/16

[52] U.S. Cl. ..... 343/801; 343/795; 343/807

[58] Field of Search ..... 343/801, 795, 343/802, 807, 813, 749, 808, 810, 727, 730; H01Q 9/16

[56] References Cited

U.S. PATENT DOCUMENTS

| | | | |
|---|---|---|---|
| 2,635,187 | 4/1953 | Dorne | 343/801 |
| 2,688,083 | 8/1954 | Hills | 343/801 |
| 2,967,300 | 1/1961 | Haughawout | 343/801 |
| 3,089,141 | 5/1963 | Odenwald | 343/801 |
| 3,239,838 | 3/1966 | Kelleher | 343/872 |
| 3,302,208 | 1/1967 | Hendrickson | 343/801 |

*Primary Examiner*—Hoanganh Le
*Attorney, Agent, or Firm*—John J. Murphey

[57] ABSTRACT

A single element, multi-frequency dipole antenna including two substantially equal arm sections of conductive material extending co-axially in a straight line in opposite directions from each other, each arm section being a mirror image of the other arm section throughout its entire length, each arm section including at least two contiguous shorter sub-sections of $j_1, j_2, \ldots j_n$ lengths, wherein $j_1$ represents the length of the innermost sub-section, sub-sections terminated by discontinuities wherein $j_1$ represents the ¼ wavelength of the highest resonant frequency and each consecutive-integer sequence of j sub-sections represent the ¼ wavelength of lower resonant frequencies.

22 Claims, 5 Drawing Sheets

SINGLE-ELEMENT, MULTI-FREQUENCY, DIPOLE ANTENNA

RELATIONSHIP TO OTHER APPLICATIONS

This is a continuation-in-part of our previous patent application carrying the same title that was filed Feb. 26, 1996 and all that carries Ser. No. 08/607,185.

BACKGROUND OF THE INVENTION

1. Field of the Invention

This invention pertains to the field of antennas. More particularly, this invention pertains to dipole antennas and to a novel single-element dipole antenna that radiates and receives multiple frequencies.

2. Description of the Prior Art

If we could visualize the radiation surrounding us as we conduct our daily lives, we would be truly amazed. There is radiation of virtually every frequency imaginable swimming about us in a huge cloud as we work and play. Much of this radiation has to do with radio and television broadcasting. This invention concerns the reception of television radiation or broadcasting and how it can be captured using newer, smaller and more efficient equipment.

Television broadcasting has been around since the 1940's. It was given a significant boost after the United States began orbiting satellites about the earth that receive television broadcasts from point sources on the earth's surface and then re-broadcast the same signal over a wider area for capture by dish antennas and cabled to various households. Huge television dish antennas sprung up along side many houses and apartment complexes for private use and television cable companies were created for disseminating cabled satellite broadcasts to various households. The result was that television has become a major aspect of everyday life both in the United States and abroad.

Original satellite television broadcasting began on what is known as the "C" band, i.e., a frequency range in the 4 gigahertz (GHz) band. The satellites that broadcast television signals to the ground are parked in geosynchronous orbits and spaced 2° apart from each other. Each of these satellites can have two dozen or more transponders each of which transmits a television signal at a standard frequency or channel. In order to increase isolation between transponders transmitting at a given frequency on the adjacent satellite, the transponders are arranged so that they are orthogonally polarized or cross-polarized, that is, their "E-fields" are at right angles to each other. This requires that the antenna feed must be capable of changing its polarization each time the receiver's channel is changed or when the receiving antenna is moved to an adjacent satellite.

A common feed antenna in television viewing incorporates the dipole radiating element. A dipole antenna is a simple resonant antenna consisting of two substantially equal arm sections of conductive material extending co-axially in a straight line in opposite directions from each other. It is called a "resonant" antenna because it creates a natural undamped frequency that is equal to, or very close to, the frequency or a divisional portion of the signal inducing electrical currents in it.

In reality, the standard dipole feed antenna for satellite dish antennas is about 1½ inches long and is housed in a short section of a wave guide terminated at one end by a conductive floor forming a cavity therein called a "cavity", that looks much like a coffee cup. Formally it is defined as a cylinder, open at one end, comprising conducting walls and serving as a resonator for electromagnetic waves. However, no wave guide or cavity is required for a more general dipole application. The cavity, with the dipole antenna at its center, is set at the focal point of an earth station with the dipole antenna facing toward the reflector. The dipole antenna receives the satellite radiation reflected from various parts of the dish and passes it down a "balun" to a processing unit for introduction into a cable leading to a television set. A "balun" is a term given to a short piece of transmission line that matches the impedance (resistance) of the antenna and which transforms from an unbalanced transmission line, such as coaxial cable, to a balanced transmission line such as twin lead transmission line that feeds the dipole. The various television satellites separate their channels by polarizing the odd and even channels orthogonal (perpendicular) to each other.

To handle the different polarizations of adjacent stations, the dipole antenna is made to rotate, first to one position for alignment with one channel, then to another position for alignment with another channel. The rotation can be as much as 180° but usually is about 90°. It is this rotation that has caused one of the big problems in TV reception.

To effectively rotate, there must be separation between the central mast of the dipole antenna and the support equipment into which the incoming signal is fed; or so the industry thought. Accordingly, there is provided on all dish antennas a rotation device that causes the dipole antenna to physically rotate about a base shaft. The incoming signal must bridge the gap between the antenna mast and the base shaft and this is accomplished by a standard rotation coupling. The incoming signal is quite weak, having travelled over many thousands of miles from the earth station to the satellite and then back to the dish, and is very susceptible to being further weakened by the slightest electrical mismatch caused by imperfect mechanical fit.

Unfortunately, the rotation coupling of the dipole antenna provides this mechanical interference. Despite refinement in design, the coupling and its rotational driver not only degrade the incoming signal but produce a certain amount of base noise that effectively lessens the net signal passed to the processing equipment down the line. The signal is greatly weakened upon reaching the discriminating and processing equipment and results in a weak TV picture.

If that were not the only problem, a new form of TV signal is now being broadcast from recently orbited satellites. This new form is call "Ku" band radiation. It is of higher frequency, in the 12 Ghz band, which means the wave length is shorter. It is also linearly polarized meaning that the antenna must be rotated to capture the signal efficiently.

The main problem with dipole antennas is that they have been thought of as limited to only one frequency band. There has been much effort expended to increase the ability of dipole antennas to receive more frequency bands. U.S. Pat. Nos. 4,125,840; 4,410,893; 4,460,877; and 5,229,782 have been issued for this purpose, however, they all have one major drawback and that is they are multi-element. This means that if one wishes a dipole antenna to pick up other bands of radiation, one must hang other components on the dipole to effect this result. For instance, U.S. Pat. Nos. 4,125,840 and 4,410,893 call for so many additional elements, in order for the dipole antenna to pick up additional frequencies, that it begins to resemble a Christmas tree with many ornaments hung about its exterior. Any time one adds more elements to an antenna, the antenna becomes far less sturdy and is affected by natural occurrences, such as weather, wind, rain, etc., that normally wouldn't affect the basic or single element antenna. In addition, more elements means more chances the antenna will move out of alignment and require additional tuning in order to remain efficient.

In addition, in the field of cellular telephone communications there is a need for such a wide band dipole antenna to allow operation over a wide band one or more of which may be assigned to a particular cellular telephone.

SUMMARY OF THE INVENTION

This invention is two-fold. First, it is a novel single element dipole antenna that is capable of simultaneously receiving multiple bands of frequencies. In the preferred embodiment, the dipole antenna efficiently picks up the "C" band and the "Ku" band of television broadcasts so that one antenna does the work where two antennas were formerly required. Secondly, it involves a novel "balun" strip that reduces signal loss occasioned during antenna rotation. The strip allows rotation without the use of a rotary joint coupling so that, not only is the incoming signal not degraded, but the normal amount of electrical mismatch, caused by the rotation device, is eliminated so that the "net" signal is far stronger. One of the unique aspects of this invention is that both parts of the invention may be easily and conveniently retro-fitted into existing television dish antennas. This means everyone can enjoy a stronger signal without having to purchase a whole new antenna system.

The first part of the invention is a single element, multifrequency, dipole antenna, comprising two equally or substantially equal arm sections of conductive material extending co-axially in a straight line in opposite directions from each other, each arm section being a mirror image of the other arm section and preferably homogeneous in composition throughout their entire length. Each arm section is made up of a series of contiguous sub-sections of $j_1$, $j_2$, $j_3$, . . . $j_n$ length, with $j_1$ being the innermost sub-section, each sub-section terminated by "discontinuities" which are abrupt changes in geometric elements of the sub-sections such as cross-sectional area or diameters of the sub-sections of $m_1$, $m_2$, $m_3$, . . . $m_n$ in 3-dimensional antennas and such as abrupt changes in widths of the sub-sections of $m_1$, $m_2$, $m_3$, . . . $m_n$ in 2-dimensional antennas. Each consecutive-integer sequence of "j" sub-sections represents a divisional portion of the wave length, such as the ¼ wave length, of a frequency. Thus, the additive consecutive-integer sequences of sub-sections, i.e., $\Sigma(j_1+j_2)$, $\Sigma(j_1+j_2+j_3)$, $\Sigma(j_1+j_2+j_3+j_4 \cdots j_n)$, represent a divisional portion of the respective wave lengths, such as the ¼ wave lengths, of lower frequencies that may be received by the dipole antenna. The discontinuities are preferably unequal to each other, i.e., $m_1 \neq m_2 \neq m_3 \ldots \neq m_n$. This may appear as abrupt changes in diameters of the sub-sections in 3-dimensional antennas and abrupt changes in widths of sub-sections in 2-dimensional antennas.

In one preferred embodiment of the invention, the antenna is shown to comprise a pair of cones with their apexes directed toward each other. Each apex is attached to the balun. The length of the cone is selected to assure operation at the desired high frequency and the overall length is adjusted to operated at the desired low frequency.

For the planar case of this embodiment, the high frequency section consists of a pair of triangular conductors. The inward directed corner of each is connected to the balun. The dimensions of the triangular conductors is adjusted to operate at a desired high frequency and a conductive extension is provided and sized to operate at the desired low frequency.

The second part of the invention is a means for interconnecting this new multi-frequency dipole antenna to signal processing equipment comprising a flexible strip of dielectric material including a printed circuit balun with traces fixed on opposite surfaces of the dielectric, and the strip made flexible enough to allow bending during rotation of the antenna into alignment with polarized signals. When used together, these inventions describe a highly efficient television receiving device that eliminates a host of problems including cleaning, tuning, adjusting, durability, etc.

Accordingly, the main object of this invention is a new dipole antenna for simultaneous receipt of more than one frequency that is far less complex than existing antennas. Other objects of the invention include a multi-frequency dipole antenna that is not constrained to a 2:1 ratio between high frequency and low frequency that exists in a very few of the prior art antennas; a dipole antenna that is suitable for printed circuit technology; a single dipole antenna that resonates at two or more frequencies rather than two high frequency dipoles that function as a single low frequency dipole; a dipole antenna that does not require a conductor to enable two frequency operation; a dipole antenna that is easily tuned to desired frequencies; and, a dipole antenna and connector that is extremely low cost to fabricate and that is retro-fittable on existing equipment without significant training.

These and other objects of the invention will become more apparent by reading the following Description of the Preferred Embodiment taken together with the drawings that are appended hereto. The scope of protection sought by the inventors may be gleaned from a fair reading of the claims that conclude this specification.

DESCRIPTION OF THE PREFERRED EMBODIMENT

Figure 1:
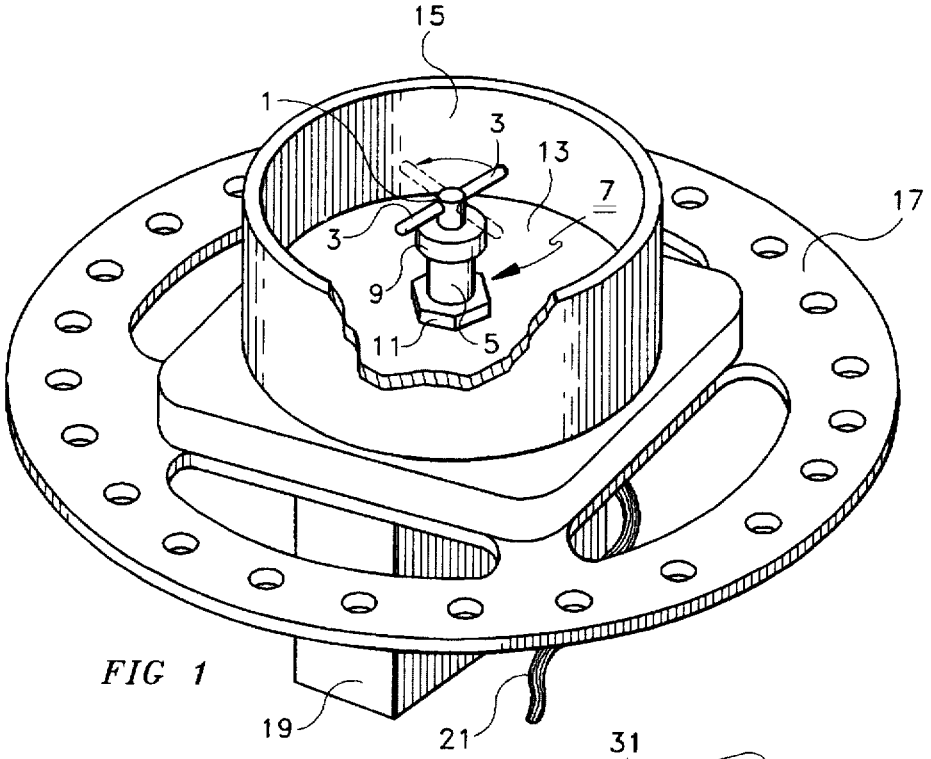
FIG. 1 is a trimetric view, partially in section, of a typical dipole antenna, mounted in a typical cavity, and connected to known equipment for processing the signals that are received by the antenna, all known in the prior art.

Turning now to the drawings, where like elements are identified with like numerals throughout the twelve figures, FIG. 1 shows the prior art dipole antenna installation of a typical television dish antenna and shows a dipole antenna 1, comprising two substantially equal arm sections 3 of conductive material extending co-axially in a straight line in opposite directions from each other from a central support mast 5, having means 7, including an outer tube 9 and a hold-down nut 11, for mounting said mast in the floor 13 of a typical cavity 15 that is attached by a mounting ring 17 and located at the focal point of a TV dish antenna (not shown). A motorized drive unit 19 is provided, under cavity floor 13, to rotate antenna 1 from one position to another, shown in dotted outline, and back again so that antenna 1 can receive polarized radiation from two directions.

A coaxial cable 21 is provided to transmit the radiant energy picked up by antenna 1 to an LNB (not shown) for cleaning up the signal before passing onto other known equipment. An LNB is a low noise block down converter that combines a low noise amplifier with a mixer that transforms the incoming signal from high carrier frequency to the lower frequency of the receiving unit or TV. A common slip-coupling fitting inside the mast (not shown) is used to bring the incoming signal into LNB no matter in what direction dipole antenna 1 is rotated.

As previously stated, two major problems with the prior art are first, that antenna 1 is mono-frequency and cannot pick up two bands of radiation simultaneously, and secondly, that the common slip fitting inside the mast, no matter how precisely made, not only attenuates some of the incoming signal, but is prone to wear and generates noise that lowers the net signal provided to the LNB.

Figure 2:
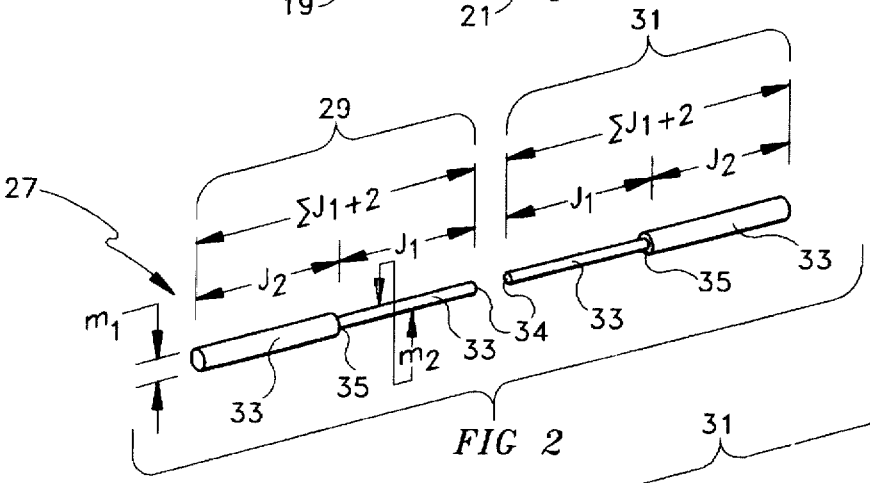
FIG. 2 is a trimetric view of a three-dimensional, two-frequency dipole antenna of this invention.
Figure 3:
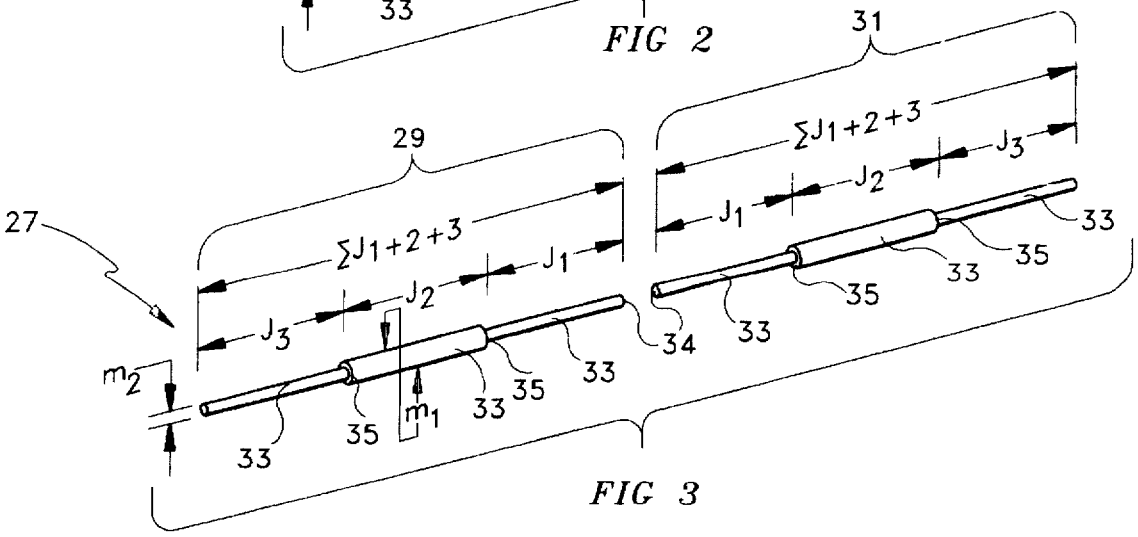
FIG. 3 is a trimetric view of a three-dimensional, three-frequency dipole antenna of this invention.
Figure 4:
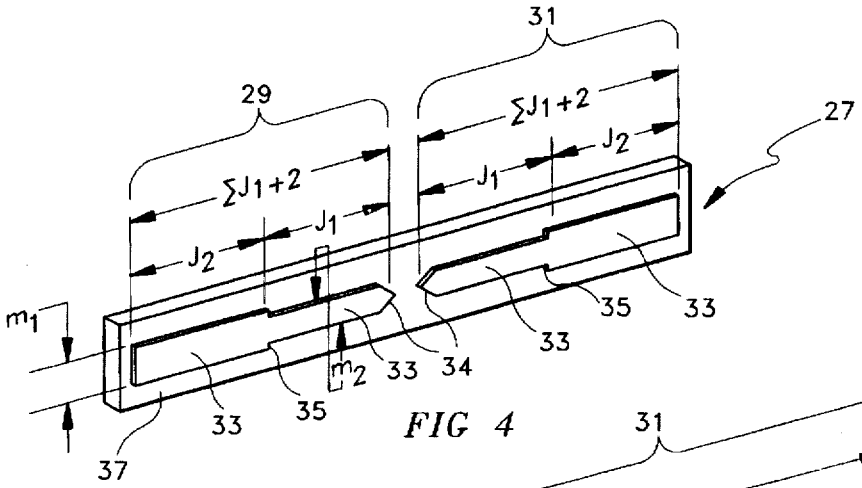
FIG. 4 is a trimetric view of a two-dimensional, two-frequency dipole antenna of this invention.

The antenna of this invention is shown in FIGS. 2–6, 8 and 9 and shown a multi-frequency antenna 27 comprised of two substantially equal arm sections, 29 and 31, of conductive material extending co-axially in a straight line in opposite directions from each other. Arm section 29 is a mirror image of arm section 31. Preferably, both arm sections are homogeneous in composition throughout their entire length such as being made of copper, steel, aluminum or other conductive material. As shown in FIGS. 2–4, each arm section 29 and 31 contains a series of contiguous consecutive sub-sections 33 of $j_1$, $j_2$, $j_3$, . . . $j_n$ length beginning at the connection point 34 with mast 5, each sub-section separated from its adjacent sub-section by a discontinuity 35. In the three-dimensional dipole antennas, shown in FIGS. 2 and 3, "m" refers to diameters or cross-sectional areas of the respective sub-sections while in the two dimensional dipole antenna, shown in FIGS. 4 and 6, where arms 29 and 31 are conductive metallic deposits on a dielectric substrate 37, "m" refers to the width of sub-section $j_1$, $j_2$, etc. In accordance with antenna theory, each sub-section 33 of length "j" represents the ¼ wave length of a frequency. These may be sized to certain lengths such as to receive the "C" band of television radiation, as well as the new "Ku" band and even the shorter wavelength "Dss" (digital) band. The abrupt change in width or diameter or cross-sectional areas between the sub-sections are considered discontinuities in the dipole antenna and thus bring about resonance at additional lower frequencies.

Further, adding the lengths of $j_1+j_2$ will create a new or second dipole antenna that will resonate at a frequency that is identified by the sum of $j_1+j_2$. Accordingly, in FIG. 2, antenna 27 can resonate at ("pick up") a frequency identified by the sub-section $j_1$ or the combined length of $j_1+j_2$. Accordingly, $\Sigma(j_1+j_2)$, $\Sigma(j_1+j_2+j_3)$, $\Sigma(j_1+j_2+j_3+j_4 \ldots j_n)$, represent the ¾ wave lengths of the frequencies below that identified by $j_1$. In addition, discontinuities 35 are different in some way from sub-sections 33. When dealing with 3-dimensional antennas, discontinuities 35 may be the abrupt change in diameter of arm sub-sections 33; when dealing with 2-dimensional dipole antennas, discontinuities 35 may be the abrupt change in widths of arm sub-sections 33; and in both cases, discontinuities 35 may be abrupt changes in size, width, cross-sectional area, and other abrupt changes such as the interposition of geometric shapes different from those of arm sub-sections 33 such as circular plates (FIG. 5) and transverse straight line segments (FIG. 6) between arm sub-sections. Other geometric shapes usable in this invention are triangles, ellipses, squares, rectangles, etc. In all cases, the discontinuities are somehow abruptly different from the size or shape of the sub-sections.

Figure 5:
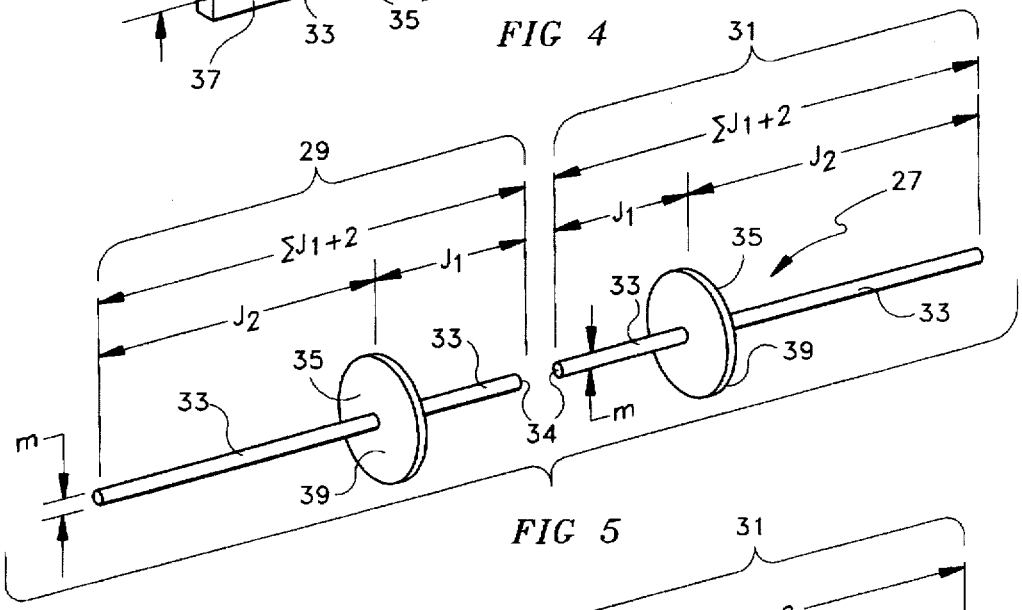
FIG. 5 is a trimetric view of another three-dimensional two-frequency antenna of this invention.

Turning to FIG. 5, another embodiment of this invention is shown where arms 29 and 31 include sub-sections 33 of $j_1$ and $j_2$ length. The discontinuity in this embodiment is not made by a change in the diameter of sub-sections 33 but by placement of a circular plate 39 transverse to the axis of said sub-sections. Here, the width "m" of sub-sections $j_1$ and $j_2$ . . . $j_n$ may be equal or unequal. The same description of the invention holds true, however, that a consecutive-integer sequence of j sub-sections will resonate at about ¼ the wavelength of a frequency lower than the individual sub-sections themselves and one must always include $j_1$ in the sequence.

Figure 6:
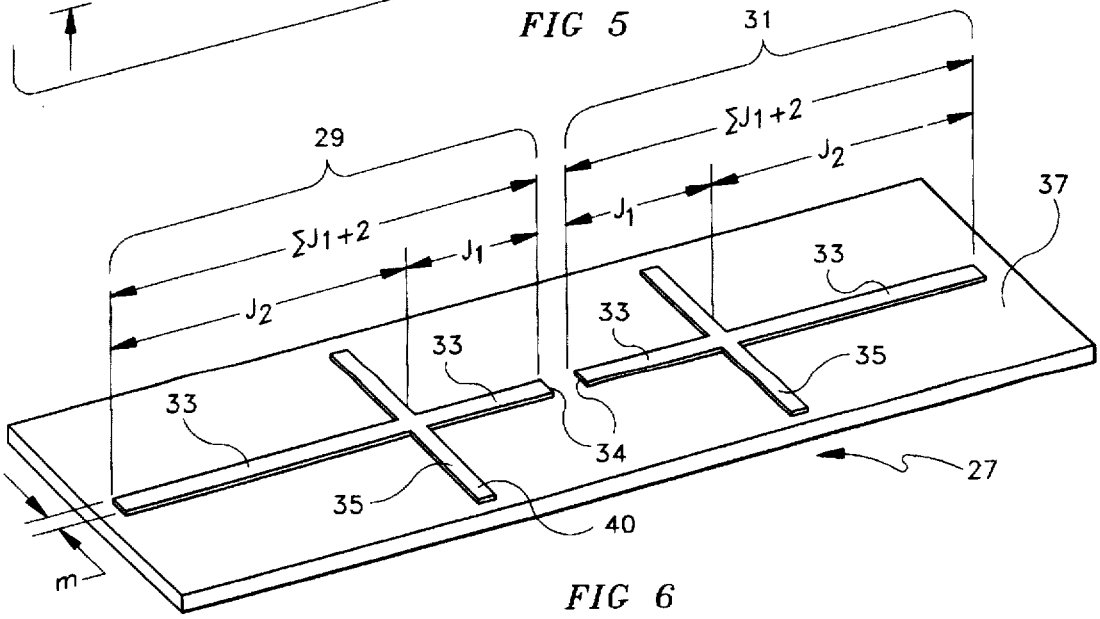
FIG. 6 is a trimetric view of another two-dimensional multi-frequency antenna of this invention.

FIG. 6 shows still another embodiment of this invention, this time in two dimensions where arm sections 29 and 31 include sub-sections 33 of $j_1$ and $j_2$ length printed on a flat dielectric substrate 37. Here, discontinuity 40 takes the form of transverse printed strakes or thin lines of deposited metallic composition 40. Substrate 37 can be made of a wide variety of dielectric materials, such as thin, i.e., 3–5 mils thick, strips of polyimide or Teflon® on which is deposited arms 29 and 31 as thin layers of metallic material.

Turning to FIGS. *7a* and *7b*, it can be seen that the balun 41 of this invention comprises a strip 45 of dielectric material, such as thin, 3–5 mils thick, strip of polyimide or Teflon®, having smooth flat opposed surfaces 47 and 49. On these surfaces are deposited conductive strips of metallic material forming a ground plane 51 on surface 47 at one end 53 of strip 45 and both halves of a twin lead conductor 55 on opposite surfaces 47 and 49 at the opposite end 57 of strip 45. Balun 41 is then positioned adjacent mast 5 as shown in FIG. 8 and each end 53 and 57 connected, as known in the prior art, namely twin lead conductors 55 connected to antenna connection points 34 (not shown) and ground plane conductors 51 connected to a diplexer 59 that processes the signals and separates one signal, such as the "C" band signal, from the signal, such as from the "Ku" band signal, for further processing.

The unique feature of balun 41 is that there is no need to provide a slip coupling with its attendant signal loss and noise generation. Balun 41 is merely allowed to wind around mast 5 as antenna arms 29 and 31 are rotated into alignment with the appropriate polarization angle of the radiation. Strip 45 can tolerate the forward and reverse rotation of dipole arms 29 and 31 without losing any of the incoming signal and without generating any noise whatsoever. The end result is a significant increase in the "net" signal passed onto to the diplexer.

Figure 8:
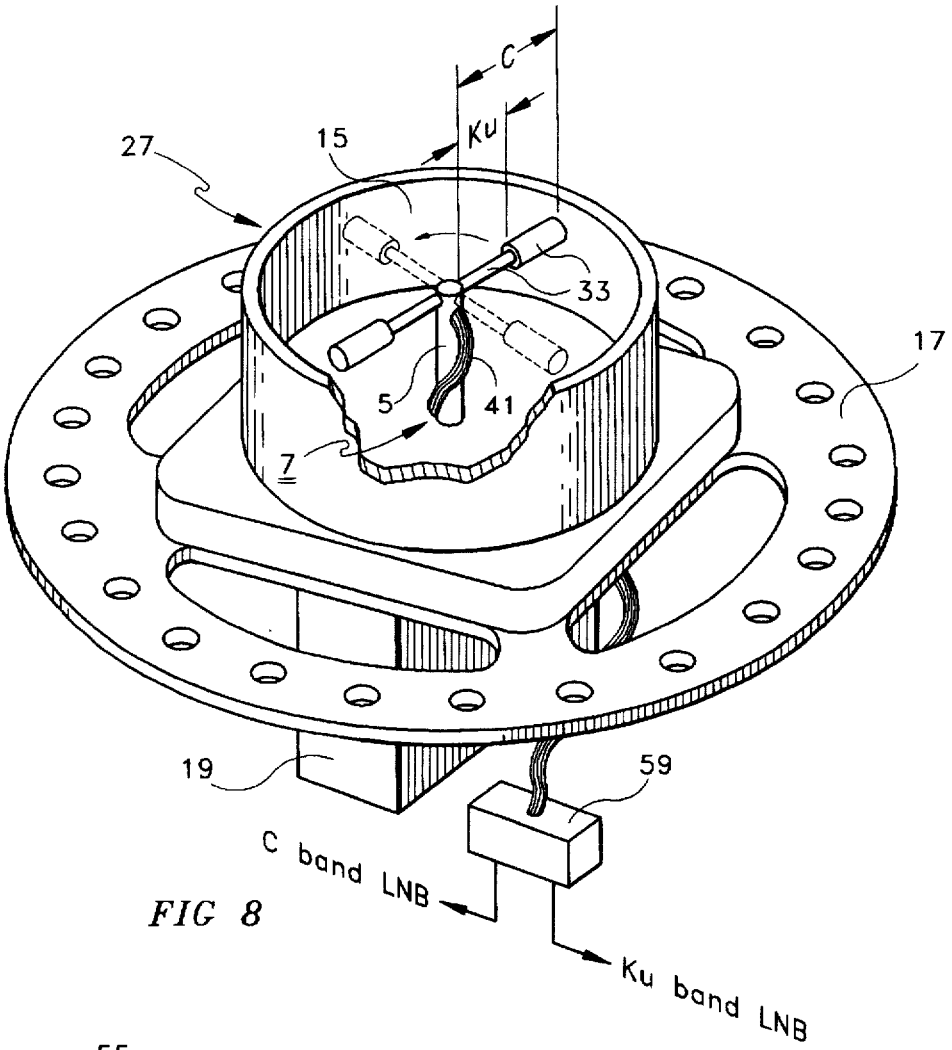
FIG. 8 is a trimetric view of an embodiment of this invention housed in a cavity for retrofit into the dish of a common TV antenna.
Figure 7A:
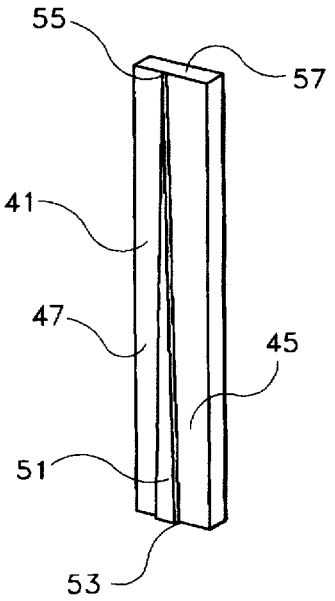
FIGS. 7*a* and 7*b* are illustrative views of the front and rear surfaces respectively of the balun of this invention.
Figure 7B:
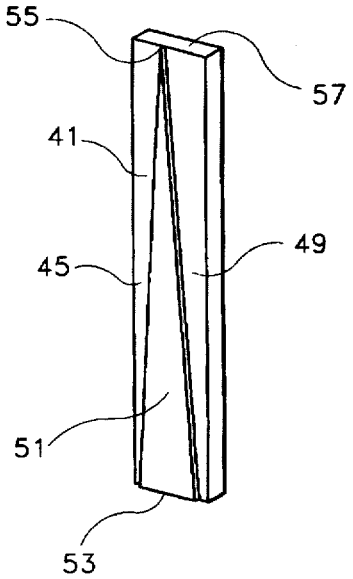

This invention can be retro-fitted onto existing television receiving dish antennas as shown in FIG. 8. The inventive multi-frequency dipole antenna 27 of this invention can be mounted by means 7 in cavity 15 and the inventive balun 41 of this invention connected by its twin lead ends 55 to the two connection points 34 and by its other ground plane end 51 to diplexer 57. Mounting ring 17 is used to place the invention in the position previously occupied by the existing unit.

Figure 9:
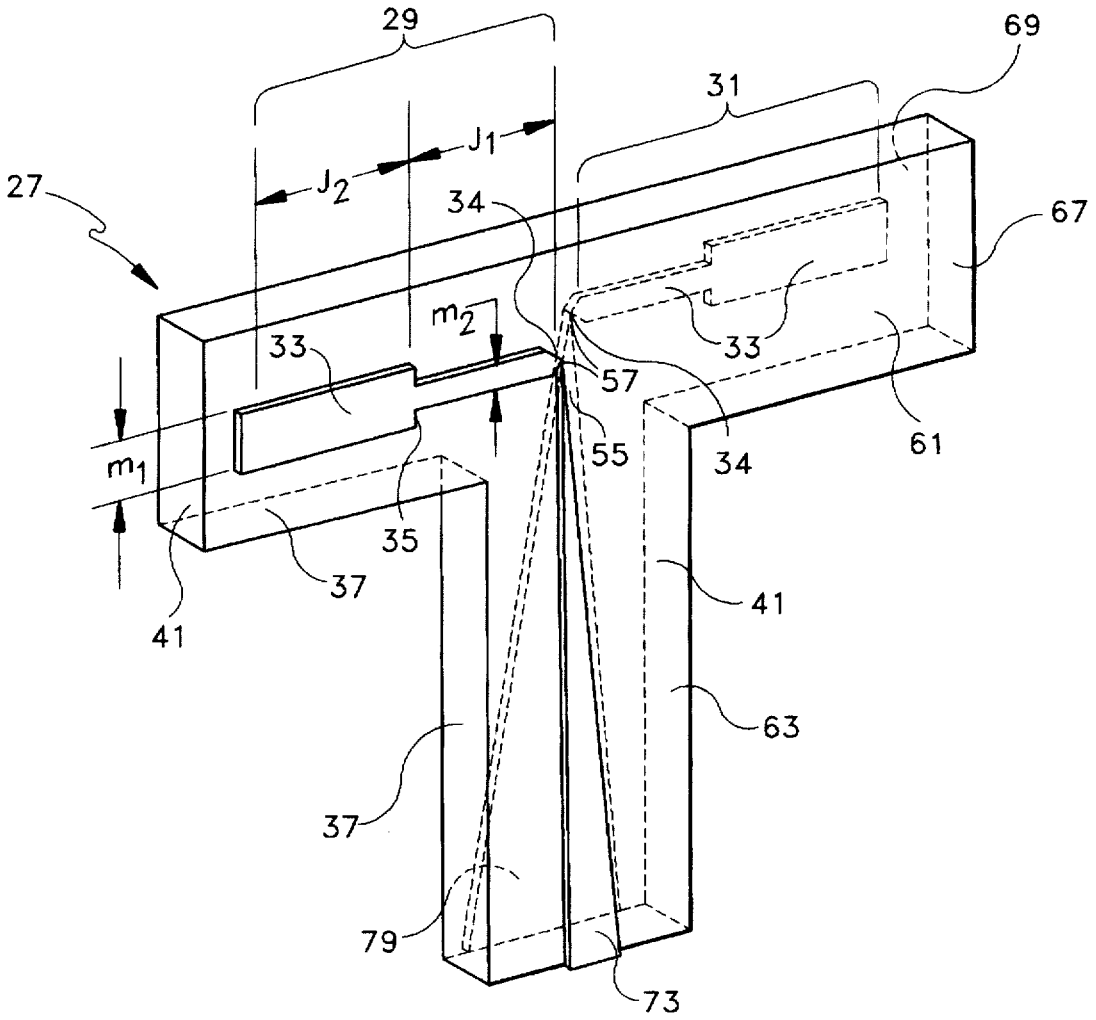
FIG. 9 is a trimetric view of another embodiment of this invention where the dipole antenna and the balun are both two-dimensional.

FIG. 9 shows a 2-dimensional antenna and balun combination of this invention wherein both of the metallic deposits are made on opposite sides of a dielectric substrate. As shown, a dielectric substrate 41 is formed in the shape of a "T" having an antenna portion 61 and a balun portion 63 joined thereto. This dielectric strip may be die-stamped from a single piece of material. On one surface 67 of antenna portion 61 is deposited arm 29 comprised of two sub-sections $j_1$ and $j_2$ in length that are separated by a discontinuity 35 that is the change in width of the sub-sections. On the opposite surface 69 of antenna portion 61 is deposited arm section 31 comprised of two other sub-sections, identical i.e., a mirror image of $j_1$ and $j_2$. On surface 67 of balun portion 63 is deposited a ground plane portion 73 that is attached at its upper end 57 as a twin lead to connection point 34 of arm 29. On the opposite surface 69 is deposited the other ground plane portion 79 that is attached at its upper end 57 as the other part of twin lead conductor 55 to connection point 34 of arm 31. The novel dipole antenna of this invention is now attached to the novel balun of this invention and the two can operate together to provide the multi-frequency aspect along with all the advantages of using the balun.

Figure 10:
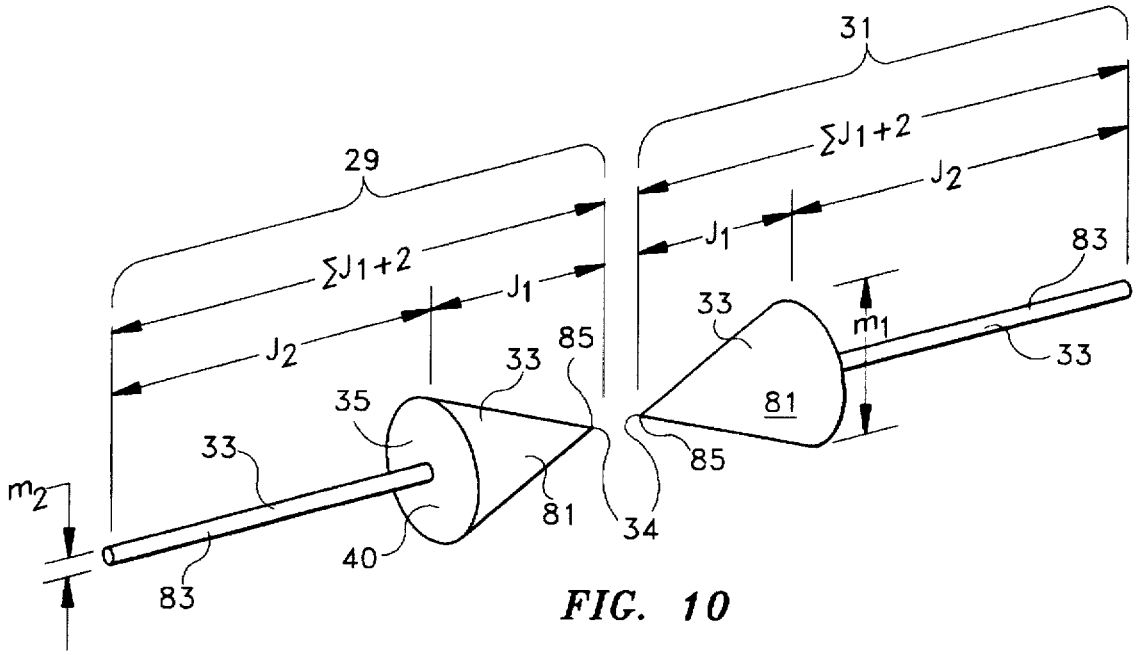
FIG. 10 is a trimetric view of a three-dimensional, two-frequency dipole antenna of this invention; and, FIG. 11 is a trimetric view of another two-dimensional two-frequency antenna of this invention.

Turning to FIG. 10, another embodiment of this invention is shown where arms 29 and 31 are shown to comprise a pair of cones 81 on stems 83 with their apexes 85 directed toward each other, said cones 81 and stems 83 including sub-sections 33 of $j_1$ and $j_2$. The discontinuity in this embodiment is made by a change in the diameter of sub-sections 33. Here, the width "m" of sub-sections $j_1$ and $j_2 \ldots j_n$ may be equal or unequal. Each apex 85 is attached to balun 41. The length of cone 81 is selected to assure operation at the desired high frequency and the overall length, $j_1$ and $j_2$, is adjusted to operated at the desired low frequency. The same description of the invention holds true, however, that a consecutive-integer sequence of j sub-sections will resonate at about ¼ the wavelength of a frequency lower than the individual sub-sections themselves and one must always include $j_1$ in the sequence.

Figure 11:
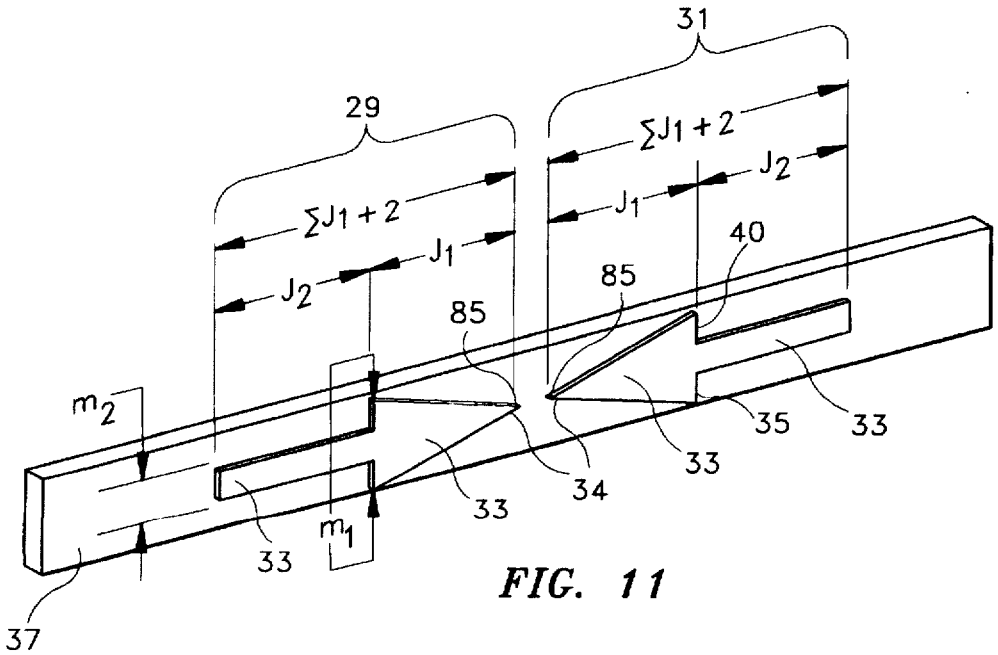

FIG. 11 shows the two-dimensional form of the embodiment shown in FIG. 10, where arm sections 29 and 31, the high frequency section, consists of a pair of triangular conductors 87 with extended stems 89, including sub-sections 33 of $j_1$ and $j_2$ length printed on a flat dielectric substrate 37. Here, discontinuity 40 takes the form of abrupt narrowing of triangular conductors 87 to the width "m" of stem 89. The inward directed corner, or apex 85, of each triangle, is connected to balun 41. The dimensions of the triangular conductors is adjusted to operate at a desired high frequency and a conductive extension is provided and sized to operate at the desired low frequency. Again, substrate 37 can be made of a wide variety of dielectric materials, such as thin, i.e., 3–5 mils thick, strips of polyimide or Teflon® on which is deposited arms 29 and 31 as thin layers of metallic material.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same results are within the scope of this invention.

What is claimed is:

1. A single element, multi-frequency band dipole antenna comprising two substantially equal arm sections of conductive material extending co-axially in a straight line in opposite directions from each other, each said arm section being a mirror image of said other arm section throughout its entire length, each said arm section comprising at least two, non-adjustable contiguous shorter sub-sections of $j_1, j_2, \ldots j_n$ in lengths, wherein $j_1$ represents the length of the innermost sub-section and each successive j unit represents the length of the next, adjacent sub-section, each said sub-section terminated by abrupt discontinuities wherein $j_1$ represents the ¼ wavelength of the highest resonant frequency band and each consecutive-integer sequence of j sub-sections represent the ¼ wavelength of progressively lower resonant frequency bands.

2. The single element, multi-frequency band dipole antenna of claim 1 wherein said discontinuities are selected from the group consisting of abrupt changes in cross-sectional areas; abrupt, non-adjustable changes in sub-section diameters; abrupt, non-adjustable changes in sub-section widths; non-adjustable transversely positioned circular plates; and, non-adjustable transversely positioned strakes interposed said sub-sections.

3. The single element, multi-frequency dipole antenna of claim 1 wherein said antenna is three-dimensional, said discontinuities are abrupt changes in diameters between diameters $m_1, m_2, \ldots m_n$ of said sub-sections and $m_1 \neq m_2 \neq \ldots m_n$.

4. The single element, multi-frequency dipole antenna of claim 1 wherein $m_1 > m_2 > \ldots m_n$.

5. The single element, multi-frequency dipole antenna of claim 1 wherein $m_1 < m_2 < \ldots m_n$.

6. The single element, multi-frequency dipole antenna of claim 5 wherein said discontinuities are geometric-shaped elements transversely fixed between said arm sub-sections.

7. The single element, multi-frequency dipole antenna of claim 1 wherein said antenna is two-dimensional, said discontinuities are abrupt changes in the respective widths $m_1, m_2, \ldots m_n$ of said sub-sections.

8. The single element, multi-frequency dipole antenna of claim 7 wherein $m_1 > m_2 > \ldots m_n$.

9. The single element, multi-frequency dipole antenna of claim 7 wherein $m_1 < m_2 < \ldots m_n$.

10. The single element, multi-frequency dipole antenna of claim 1 wherein said antenna arm sections are homogeneous in composition throughout their entire length.

11. The single element, multi-frequency dipole antenna of claim 1 including two sub-sections in each said arm.

12. The single element, multi-frequency dipole antenna of claim 1 including three sub-sections in each said arm.

13. A three-dimensional single-element, multi-frequency band, dipole antenna, comprising:

a) two substantially equal arm sections of conductive material extending co-axially in a straight line in opposite directions from each other;

b) each said arm section being a mirror image of said other arm section; and, c) each said arm section comprising a series of non-adjustable contiguous sub-sections of $j_1, j_2, j_3, \ldots j_n$ lengths and of $m_1, m_2, m_3, \ldots m_n$ cross-sectional areas, each sub-section separated from the adjacent sub-section by an abrupt discontinuity and wherein $j_1$, represents said innermost sub-section and each successive j unit represents the length of the next, adjacent sub-section, and each consecutive-integer sequence of j sub-sections, such as $\Sigma(j_1+j_2)$, $\Sigma(j_1+j_2+j_3)$, and $\Sigma(j_1+$ $j_2+j_3+j_4 \ldots j_n$), represent the ¼ wavelength of progressively lower resonant frequency bands.

14. The antenna of claim 13 wherein $m_1<m_2<m_3 \ldots <m_n$.

15. The antenna of claim 13 wherein $m_1>m_2>m_3 \ldots >m_n$.

16. The single element, multi-frequency dipole antenna of claim 13 including two sub-sections in each said arm.

17. The single element, multi-frequency dipole antenna of claim 13 including three sub-sections in each said arm.

18. The antenna of claim 13 wherein said antenna arms are homogeneous in composition throughout their entire length.

19. The single element, multi-frequency dipole antenna of claim 13 wherein said discontinuities are selected from the group consisting of abrupt changes in sub-section cross-sectional areas, abrupt changes in sub-section diameters, abrupt changes in sub-section widths, transversely positioned circular plates, and transversely positioned strakes interposed said sub-sections.

20. A single element, multi-frequency band, dipole antenna comprising:

a) mast of terminal length including means for mounting said mast at one end in a cavity;

b) two substantially equal arm sections of conductive material extending in a straight line in opposite directions from the other end of said mast section and at right angles thereto;

c) each said arm section being a mirror image of said other arm section throughout its entire length; and, d) each said arm section comprising a series of non-adjustable contiguous sub-sections of $j_1, j_2, j_3 \ldots j_n$ lengths and of $m_1, m_2, m_3 \ldots m_n$ widths and terminated by abrupt discontinuities, wherein $j_1$ represents the ¼ wave length of the highest resonant frequency band and each successive j unit represents the length of the next, adjacent sub-section and $\Sigma(j_1+j_2)$, $\Sigma(j_1+j_2+j_3)$, $\Sigma(j_1+j_2+j_3+j_4 \ldots j_n)$, represents the ¼ wave lengths of the progressively lower frequency bands.

21. A three-dimensional single element, multi-frequency band, dipole antenna, comprising:

a) two substantially equal arm sections of conductive material extending co-axially in a straight line in opposite directions from each other;

b) each said arm section being a mirror image of said other arm section; and, c) said arm sections including two inner non-adjustable cone-shaped sub-sections with their apexes directed toward each other, said apexes for connection to a common balun, each said arm section further comprising a series of contiguous cone-shaped sub-sections of $j_1, j_2, j_3, \ldots j_n$ lengths and of $m_1, m_2, m_3, \ldots m_n$ cross-sectional areas, each sub-section separated from the adjacent sub-section by an abrupt discontinuity and wherein $j_1$ represents said innermost sub-section and each successive j unit represents the length of the next, adjacent sub-section, each consecutive-integer sequence of j sub-sections, such as $\Sigma(j_1+j_2)$, $\Sigma(j_1+j_2+j_3)$, and $\Sigma(j_1+j_2+j_3+j_4 \ldots j_n)$, represent the ¼ wavelength of progressively lower resonant bands.

22. A two-dimensional single element, multi-frequency, dipole antenna, comprising:

a) two substantially equal arm sections of conductive material mounted on a dielectric substrate and extending co-axially in a straight line in opposite directions from each other;

b) each said arm section being a mirror image of said other arm section; and, c) said arm sections including two inner triangular-shaped elements with their apexes directed toward each other, said apexes for connection to common balun, each said arm section further comprising a series of contiguous sub-sections of $j_1, j_2, j_3, \ldots j_n$ lengths and of $m_1, m_2, m_3, \ldots$ cross-sectional areas, each sub-section separated from the adjacent sub-section by a discontinuity and wherein $j_1$ represents said innermost sub-section and each consecutive-integer sequence of j sub-sections, such as $\Sigma(j_1+j_2)$, $\Sigma(j_1+j_2+j_3)$, and $\Sigma(j_1+j_2+j_3+j_4 \ldots j_n)$, represents the ¼ wavelength of lower resonant frequencies.

* * * * *